US005429529A

United States Patent [19]

Hashizawa et al.

[11] Patent Number: 5,429,529

[45] Date of Patent: Jul. 4, 1995

[54] STRUCTURE FOR CONNECTING SHIELDED-CABLE END

[75] Inventors: Shigemi Hashizawa; Shigemitsu Inaba, both of Shizuoka, Japan

[73] Assignee: Yazaki Corporation, Tokyo, Japan

[21] Appl. No.: 208,335

[22] Filed: Mar. 8, 1994

[30] Foreign Application Priority Data

Mar. 8, 1993 [JP] Japan ..... 5-046600

[51] Int. Cl.[6] ..... H01R 13/658

[52] U.S. Cl. ..... 439/610; 439/98; 439/275

[58] Field of Search ..... 439/98, 99, 610, 275; 174/74 R, 75 C, 84 C

[56] References Cited

U.S. PATENT DOCUMENTS 3,281,756 10/1966 O'Keefe et al. ..... 439/99
3,644,874 2/1972 Hutter ..... 439/99

FOREIGN PATENT DOCUMENTS 58-147183 10/1983 Japan .
3-126374 12/1991 Japan .

*Primary Examiner*—Gary F. Paumen
*Attorney, Agent, or Firm*—Heslin & Rothenberg

[57] ABSTRACT

A structure for connecting a shielded-cable end in which the braid of the shielded cable is simply and reliably connected to a metal sleeve. The metal sleeve includes a through-tube the diameter of which is greater than that of an external sheath disposed around the braid of the shielded cable and a through-hole which is smaller than the outer diameter of the braid and is equivalent to or greater than the outer diameter of an internal sheath within the braid. The braid is squeezed and accommodated within the through-tube of the metal sleeve and the through-tube is crimped and connected to the braid. An enlarged connecting portion serially extending from the through-tube is pressed against a conductive shield plate of a shield connector.

10 Claims, 5 Drawing Sheets

STRUCTURE FOR CONNECTING SHIELDED-CABLE END

BACKGROUND OF THE INVENTION

1. Field of the Invention

The present invention relates to a structure for connecting a shielded-cable end, and .more particularly, a structure for connecting a shielded-cable end in which a braid of the shielded cable is simply and reliably connected to a metal sleeve.

2. Description of the Related Art

Conventionally, one example of structures for connecting a shielded-cable end of this type is disclosed in Japanese Utility Model Laid-Open No. 58-147183. As illustrated in FIG. 7, a shielded cable generally denoted by 20 includes an internal sheath 22 for covering core wires 30, a conductive braid 23 arranged around the internal sheath 22, and an external sheath 21 for covering the braid 23. The end of the shielded cable is cut with a cutter so as to expose only the internal sheath 22. As shown in FIG. 8, a ring-like metal adapter generally denoted by 24 having a cylindrical portion 25 is fit around the internal sheath 22 and the cylindrical portion 25 is inserted between the internal sheath 22 and the braid 23, thereby connecting the braid 23 to the metal adapter 24. FIG. 8 further shows a shield connector generally denoted by 29 using the above end-connecting structure. The shield connector 29 includes a conductive case 28 from one of the sides of which connector pins 31 project. The cylindrical portion 25 of the adapter 24 and the external sheath 21 are clamped and secured by a metal clamp 27, and a contacting spring 26 is also arranged around the metal adapter 24 so as to be brought into contact with the conductive case 28 of the shield connector 29, thereby electrically interrupting the connector 29. The core wires 30 within the internal sheath 22 are connected to each of the connector pins 31 projecting from the connector case 28.

However, in the above conventional end-connecting structure, skill is required to cut off the braid 23 of the shielded cable with a cutter, and some of the braid 23 formed of the narrow metal wires might remain in a mustache-like form if the cutter does not cut well. Furthermore, if the cutter cuts too well, it might cut as far as the internal sheath 22 so as to short-circuit the braid 23 and the core wires 30. Skill is also required to insert the cylindrical portion 25 of the metal adapter 24 between the braid 23 and the internal sheath 22.

SUMMARY OF THE INVENTION

Accordingly, in order to solve the above problems peculiar to the related art, an object of the present invention is to provide a structure for connecting a shielded-cable end in which in order to manufacture a shield connector, or the like, it is not necessary to cut off the braid of a shielded cable and the stripping operation is thus simplified, thereby enhancing the easy handling and connecting of the shielded cable.

Another object of the present invention is to provide a shield connector to which the above structure for connecting a shielded-cable end is applied.

In order to achieve the above objects, the present invention provides a structure used for connecting a shielded-cable end including an internal sheath for covering core wires, a conductive braid for covering the internal sheath and an external sheath for covering the braid; the structure comprising a metal sleeve including:

a through-tube having a diameter greater than that of the external sheath; and a through-hole disposed at the forward end of the through-tube, the diameter of the hole being smaller than the outer diameter of the braid and being equivalent to or greater than the outer diameter of the internal sheath, the end of the shielded cable being fit into and past the metal sleeve. An enlarged portion for contacting a conductive shield plate may be serially extended from the base end of the through-tube when a shield connector having a conductive shield plate is manufactured.

According to the above construction, when the metal sleeve is fit around the shielded cable in which the external sheath is stripped so as to expose the braid on the internal sheath, only the internal sheath passes through the through-hole disposed at the forward end of the metal sleeve and the braid is squeezed into the through-tube by the outer periphery of the through-hole. The through-tube is then crimped into the squeezed braid, thereby reliably contacting the braid to the metal sleeve.

The enlarged portion formed at the base end of the through-tube is pressed against the conductive shield plate of the shield connector, thereby reliably performing the electrical interruption.

Other objects, features and advantages of the present invention will be apparent from the following description of the preferred embodiments of the invention in conjunction with the accompanying drawings.

DESCRIPTION OF THE PREFERRED EMBODIMENTS

Figure 1:
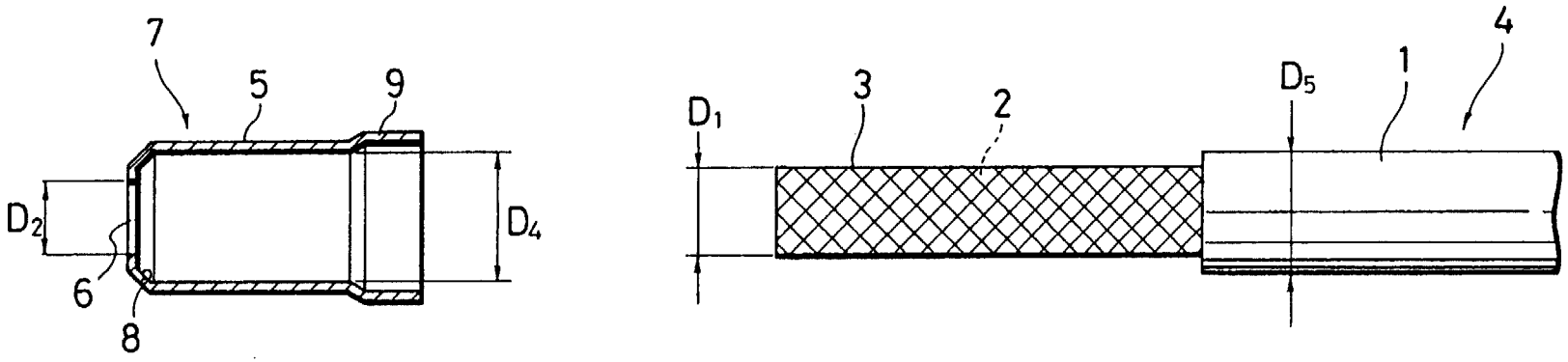
FIG. 1 is a longitudinal sectional view showing one embodiment of a structure for connecting a shielded-cable end according to the present invention.
Figure 2:
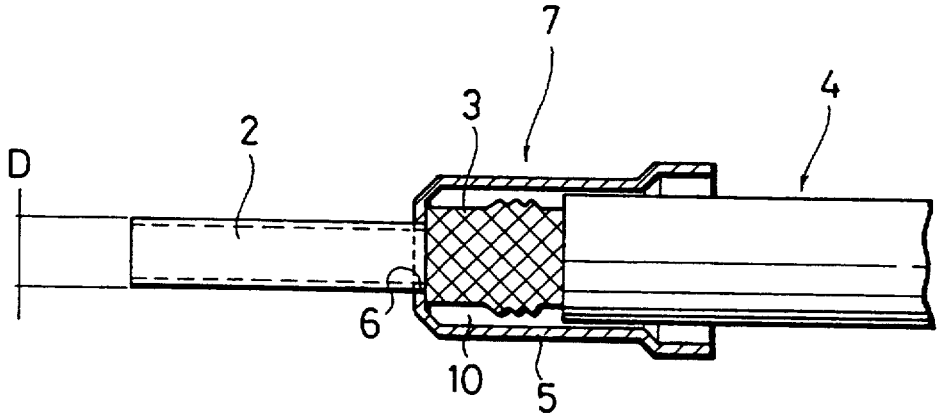
FIG. 2 is a longitudinal sectional view showing a shielded cable passing through a metal sleeve.
Figure 3:
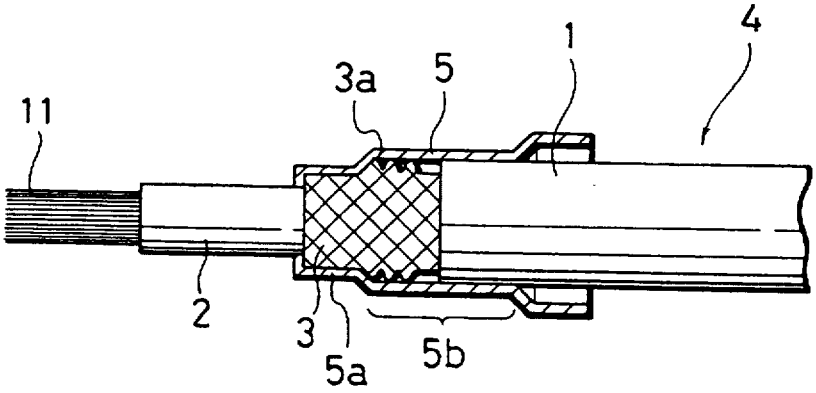
FIG. 3 is a longitudinal sectional view showing the metal sleeve being crimped.

FIGS. 1–3 show one embodiment of a structure for connecting a shielded-cable end according to the present invention. A shielded cable generally denoted by 4 includes an internal sheath 2 for covering core wires (not shown), a braid 3 wound by narrow conductive metal wires in a lattice-like shape and an external sheath 1 for covering the braid 3. The external sheath 1 is stripped and the braid 3 is exposed at the end of the shielded cable 4. The end-connecting structure is formed of a ring-like metal sleeve 7 used for connecting the end of the shielded cable 4. The metal sleeve 7 comprises a through-tube 5 having a sufficient width for receiving the external sheath 1 of the shielded cable and a through-hole 6 arranged at the forward end of the through-tube 5 for receiving the internal sheath 2 of the shielded cable 4.

The metal sleeve 7 is formed of copper, brass, phosphor bronze, or the like. An inwardly-disposed collar 8 extends connectingly from the forward end of the through-tube 5. The through-hole 6 is disposed at the center of the inward collar 8 and the inner diameter $D_2$ thereof is smaller than the outer diameter $D_1$ of the braid 3 and is equivalent to or slightly greater than the outer diameter $D_3$ (FIG. 2) of the internal sheath 2 inside the braid 3. The inner diameter $D_4$ of the through-tube 5 is slightly greater than the outer diameter $D_5$ of the external sheath 1 of the shielded cable 4. An enlarged portion 9 greater than the outer diameter of the through-tube 5 is formed at the rear end of the through-tube 5. As is described below, when the structure for connecting the shielded-cable end is applied to a connector, the enlarged portion 9 is brought into contact with the connector and attaches a water-proof plug thereto.

When the shielded cable 4 is inserted into the metal sleeve 7, as shown in FIG. 2, only the internal sheath 2 passes through the through-hole 6 and the braid 3 is squeezed by the inward collar 8 disposed around the through-hole 6 in the direction in which the sleeve 7 is forced so that the braid 3 is accommodated in the space 10 formed within the forward end of the through-tube 5 and the internal sheath 2.

Further, as illustrated in FIG. 3, the forward end of the through-tube 5 is crimped into the braid 3 by a crimping tool (not shown) so as to form a first crimped portion 5*a*, and the through-tube 5 is further crimped from the first crimped portion 5*a* to the portion covering the external sheath 1 at the base end so as to form a second crimped portion 5*b*, thus forming the two crimped portions. The braid 3 is closely connected to the through-tube 5 by means of the first crimped portion 5*a* and the braid squeezed portion 3*a* at the base end of the braid 3 is brought into contact with the through-tube 5 by means of the second crimped portion 5*b*, thereby fastening the external sheath 1. However, it is not essential to crimp the second portion 5*b*. The caulking tool uses an upper and lower compressor-type member having a hexagonal section, or the like. Thus, the braid 3 is separated from the external sheath 1 without a cutting operation and is reliably brought into contact with the metal sleeve 7.

Figure 4:
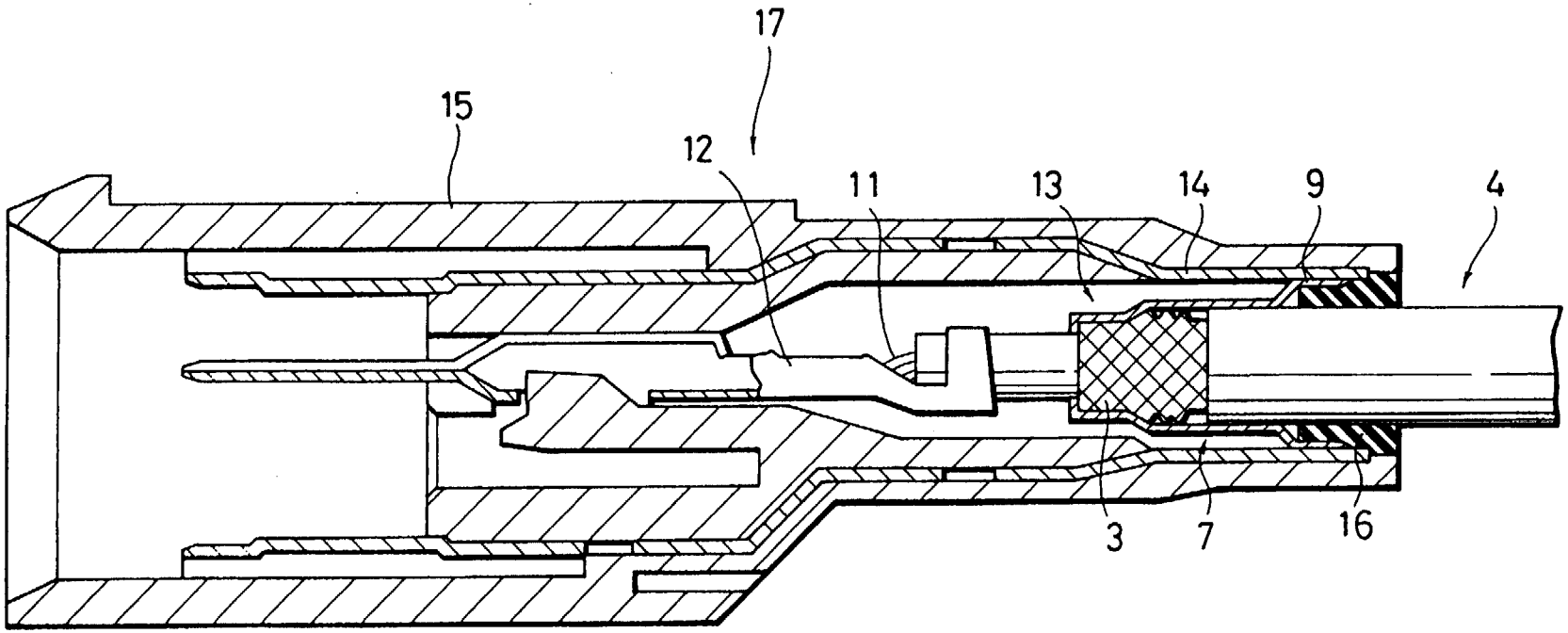
FIG. 4 is a longitudinal sectional view showing a shield connector to which the above end-connecting structure is applied.

FIG. 4 shows a shield connector generally denoted by 17 to which the structure for connecting the shielded-cable end is applied. The shield connector 17 includes a connector housing 15 to which a metal shield plate 14 is internally connected. The forward end of the internal sheath 2 of the shielded cable 4 which passes through the metal sleeve 7 is stripped so as to expose the core wires 11 to which a terminal 12 is connected. The terminal 12 and the shielded-cable end structure 13 are inserted into the connector housing 15. The enlarged portion 9 at the rear end of the metal sleeve 7 is brought into contact with the metal shield plate 14, thereby connecting the braid 3 of the shielded cable 4 and the metal shield plate 14. A water-proof rubber plug 16 is inserted and fixed to the enlarged portion 9 which is pressed to the metal shield plate 14 due to the elasticity of the rubber plug 16.

Figure 5:
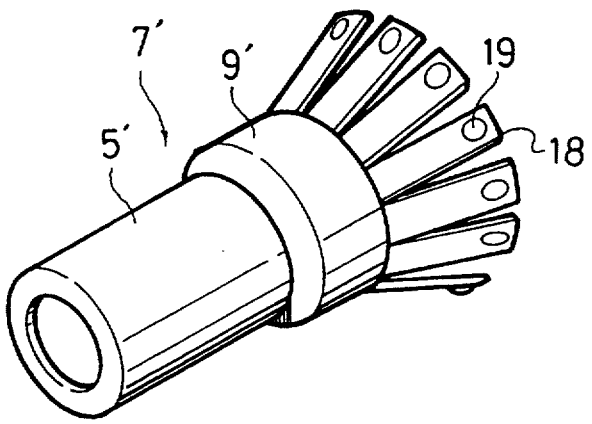
FIG. 5 is a perspective view showing another embodiment of the metal sleeve.

FIG. 5 shows another embodiment of the metal sleeve. The metal sleeve 7' is formed in such a way that a plurality of contacting elastic strips 18 which radially diverge outwardly are serially extended from the enlarged portion 9' disposed at the rear end of the through-tube 5'. Contacting proturberances 19 are formed on each of the elastic strips 18 so as to be pressed against the metal shield plate 14 of the connector 17 shown in FIG. 4 due to the elasticity of the elastic strips 18.

Figure 6:
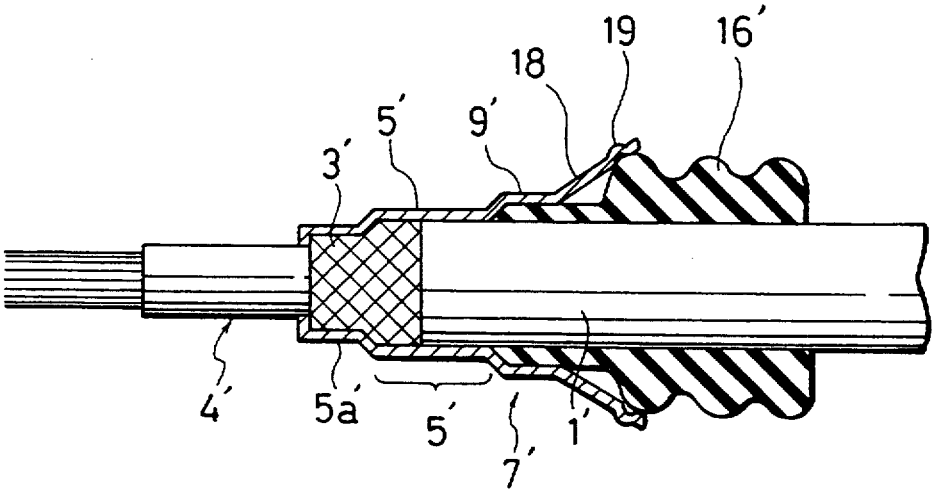
FIG. 6 is a longitudinal sectional view showing the metal sleeve being connected and secured to the cable end.
Figure 7:
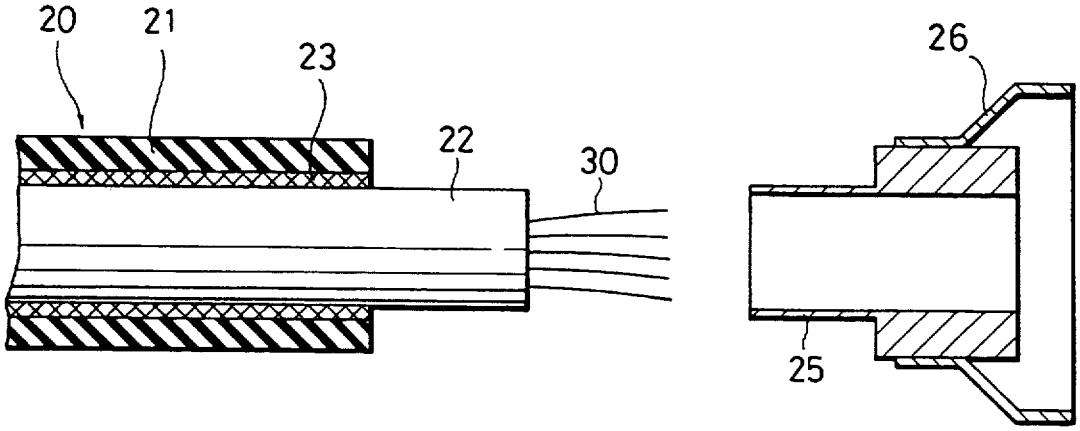
FIG. 7 PRIOR ART
FIG. 7 is a longitudinal sectional view showing a conventional structure for connecting a shielded-cable end.
Figure 8:
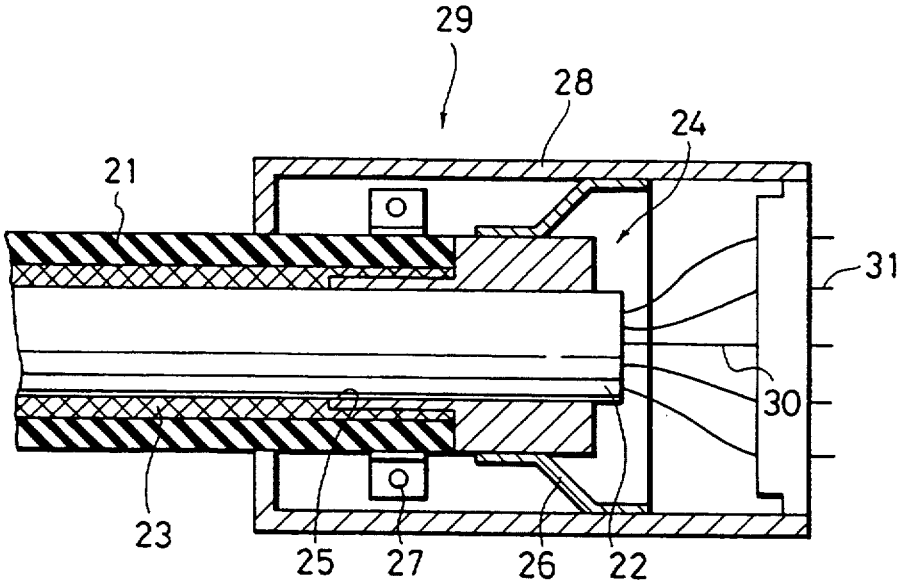
FIG. 8 PRIOR ART
FIG. 8 is a longitudinal sectional view showing a conventional shield connector.

FIG. 6 shows the metal sleeve 7' being connected and fixed in a manner similar to that in the previous embodiment. The metal sleeve 7' is provided with the first crimped portion 5*a* which is crimped into the squeezed braid 3' of the shielded cable 4' at the forward end of the metal sleeve 7' and the second crimped portion 5*b* which is crimped into the external sheath 1' (second crimping is not essential). The forward end of the water-proof rubber plug 16' is crimped and fastened to the rear end of the enlarged portion 9' and the elastic strips 18 serially extended from the enlarged portion 9' diverge along the rubber plug 16'. The elastic strips 18 are reliably connected to the metal shield plate 14 due to the elasticity, simultaneously with the insertion of the elastic strips 18 into the connector 17.

What is claimed is:

1. A structure used for connecting a shielded-cable end including an internal sheath for covering core wires, a conductive braid for covering said internal sheath and an external sheath for covering said braid; said structure comprising a metal sleeve including: a through-tube having a diameter greater than that of said external sheath, and a through-hole disposed at the forward end of said through-tube, the diameter of said hole being smaller than the outer diameter of said braid and being equivalent to or greater than the outer diameter of said internal sheath, the end of said shielded cable being fit into and past said metal sleeve an inward collar being formed from the forward end of said through-tube to said through-hole, thereby squeezing and accommodating said braid within said through-tube.

2. A structure according to claim 1, wherein said through-tube is crimped and connected to said braid.

3. A structure according to claim 2, wherein said through-tube is crimped in the two steps of caulking the forward end of said through-tube so as to be closely connected to said braid and crimping the base end of said through-tube so as to fasten said external sheath to said through-tube.

4. A structure used for connecting a shielded-cable end, said structure being used when a shield connector having a conductive shield plate is manufactured, said shielded cable including an internal sheath for covering core wires, a conductive braid for covering said internal sheath and an external sheath for covering said braid, said structure comprising a metal sleeve including: a through-tube having a diameter greater than that of said external sheath; and a through-hole disposed at the forward end of said through-tube, the diameter of said hole being smaller than the outer diameter of said braid and being equivalent to or greater than the outer diameter of said internal sheath, said metal sleeve being provided with an inward collar from the forward end of said through-tube to said through-hole so as to allow said braid to be squeezed and accommodated within said through-tube which is then crimped and connected to the squeezed braid, said metal sleeve having an enlarged portion at the rear end of said through-tube, the diameter of said enlarged portion being greater than the outer diameter of said through-tube, thereby contacting said enlarged portion to said conductive shield plate.

5. A structure according to claim 4, wherein a waterproof rubber plug is inserted into said enlarged portion within said through-tube.

6. A structure according to claim 5, wherein said enlarged portion of said through-tube has a plurality of radially-diverging contacting elastic strips.

7. A structure according to claim 6, wherein contacting proturberances are formed on the surface of said radially-diverging contacting elastic strips.

8. A shield connector comprising:

a shielded cable including an internal sheath for covering core wires, a conductive braid for covering said internal sheath and an external sheath for covering said braid;

a metal sleeve including a through-tube the diameter of which is greater than that of said external sheath, and a through-hole formed at the forward end of said through-tube, the diameter of said hole being smaller than the outer diameter of said braid and being equivalent to or greater than the outer diameter of said internal sheath, the end of said shielded cable being fit into and past said metal sleeve;

connector pins connected to said core wires; and a connector housing to which a conductive shield plate is internally connected, said housing accommodating said connector pins and the shielded-cable end passed through said metal sleeve.

9. A connector according to claim 8, wherein said through-tube has an enlarged portion at the rear end thereof, the diameter of said enlarged portion being greater than the outer diameter of said through-tube, thereby contacting said enlarged portion to said conductive shield plate.

10. A connector according to claim 9, wherein said enlarged portion of said through-tube has a plurality of radially-diverging contacting elastic strips.

* * * * *